United States Patent [19]

Kumazawa

[11] Patent Number: 4,892,503

[45] Date of Patent: Jan. 9, 1990

[54] ACTION TOY VEHICLE WITH CONTROLLABLE AUXILIARY WHEEL

[75] Inventor: Kiyoshi Kumazawa, Tokyo, Japan

[73] Assignee: Apollo Corporation, Tokyo, Japan

[21] Appl. No.: 140,167

[22] Filed: Dec. 31, 1987

[30] Foreign Application Priority Data

| | | | |
|---|---|---|---|
| Aug. 5, 1987 | [JP] | Japan | 62-195747 |
| Aug. 11, 1987 | [JP] | Japan | 62-200362 |
| Oct. 29, 1987 | [JP] | Japan | 62-274214 |

[51] Int. Cl.[4] ..... A63H 17/39

[52] U.S. Cl. ..... 446/456; 446/437; 446/460

[58] Field of Search ..... 446/437, 436, 456, 454, 446/460, 462

[56] References Cited

U.S. PATENT DOCUMENTS

| | | | |
|---|---|---|---|
| 2,168,788 | 8/1939 | Biller | 446/436 |
| 3,574,267 | 1/1971 | Schorsch . | |
| 3,984,939 | 10/1976 | Wolgamot et al. | 446/462 X |
| 4,556,397 | 12/1985 | Arad et al. | 446/437 X |
| 4,568,306 | 2/1986 | Martin | 446/437 |

FOREIGN PATENT DOCUMENTS

| | | | |
|---|---|---|---|
| 938835 | 2/1956 | Fed. Rep. of Germany | 446/436 |
| 641563 | 8/1950 | United Kingdom . | |
| 1342861 | 1/1974 | United Kingdom . | |
| 2124094 | 2/1984 | United Kingdom . | |
| 2152393 | 8/1985 | United Kingdom . | |

*Primary Examiner*—Mickey Yu

*Attorney, Agent, or Firm*—Bachman & LaPointe

[57] ABSTRACT

A remote controlled toy vehicle includes a plurality of road wheels rotatably suspended from a vehicular chassis and an auxiliary wheel mounted on a structure which can be selectively lowered and steered via remote control in a manner which permits the vehicle to be operated on the auxiliary wheel and two of the four road wheels.

28 Claims, 23 Drawing Sheets

ACTION TOY VEHICLE WITH CONTROLLABLE AUXILIARY WHEEL

BACKGROUND OF THE INVENTION

1. Field of the Invention

The present invention relates to a toy vehicle and more specifically to a remote controlled toy vehicle which includes a mechanism which permits the vehicle to imitate dynamic vehicle operations such a wheel stands and the like while being selectively steerable at all times.

2. Description of the Prior Art

FIG. 1 shows a first example of a toy vehicle which is adapted to mimic or imitate dynamic vehicle operation such as wheel stands (sometimes referred to as a wheely). In this arrangement a socket 1 is formed in the lower surface of the vehicle chassis 2 and is adapted to receive a member 4 on which a wheel 6 is rotatably supported. When it is desired to imitate a wheel stand, the member 4 is manually inserted in place. However, this arrangement has lacked appeal when applied to battery operated remote control toys in that it is necessary to manually insert and remove the member 4 on which the additional wheel is mounted. This, apart from being troublesome, of course renders it impossible to induce a wheel stand while the vehicle is running and further renders steering of the same with the member inserted impossible.

Efforts to eliminate the need for the member have been made but the large amount of torque which must be suddenly applied to the rear wheels of the vehicle in order to overcome the inertia of the vehicle and lift the front wheels off the ground is so high that any arrangement which can provide the same cannot be easily controlled and cannot be stably used for normal running. Further, the drain on the power source (batteries) and the load on the transmission is abnormally high and prevents any realistic and economically feasible toy design.

FIG. 2 shows a second prior art toy design proposed in order to enable the vehicle to run on two wheels (Viz., one front wheel and one rear wheel). This arrangement has included extensions 8 which extend from the hubs of the wheels 10 and which contact the ground in the manner illustrated. However, this arrangement when applied to remote controlled battery powered type toys has proven difficult to roll sufficiently to induce the illustrated attitude and then subsequently steer. In this connection elevating the center of gravity and providing specially shaped tires to some extent alleviates the difficulties but severely limits the design of the vehicles.

SUMMARY OF THE INVENTION

It is an object of the present invention to provide a toy vehicle which can remotely controlled and which can be selectively induced in a controlled manner to assume attitudes which resemble those when real automotive vehicles are driven in a manner which induces a wheel stand, driven on two wheels and the like.

In brief, the above object is achieved by a remote controlled toy vehicle including an auxiliary wheel mounted on a structure which can be selectively lowered and steered via remote control in a manner which permits the vehicle to be operated on the auxiliary wheel and one or more of the road wheels.

More specifically, the present invention takes the form of a toy vehicle comprising: a chassis; a plurality of road wheels or the equivalents (e.g. tank tracks etc.,); an auxiliary wheel; and a structure for supporting the auxiliary wheel, the structure being so constructed and arranged as to be selectively lowered below the vehicle chassis.

BRIEF DESCRIPTION 0F THE DRAWINGS

The metes and bounds of the present invention will become clearly appreciated as the description of the preferred embodiments is made hereinafter in conjunction with the appended drawings in which.

DETAILED DESCRIPTION OF THE PREFERRED EMBODIMENTS

Figure 1:
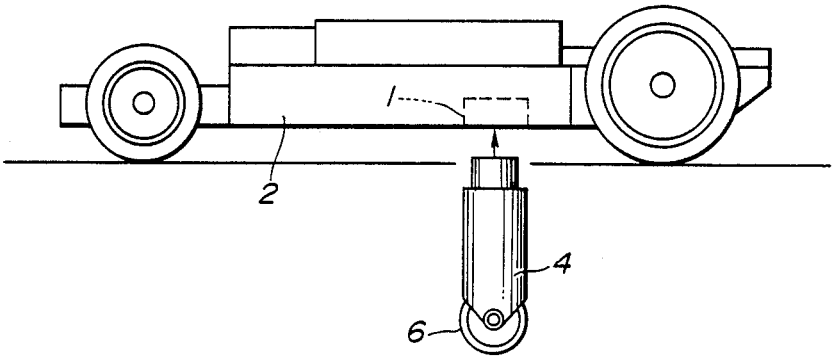
FIG. 1 (PRIOR ART)
FIG. 1 is a side elevation view of the prior art arrangement discussed in the opening paragraphs of the instant disclosure.
Figure 2:
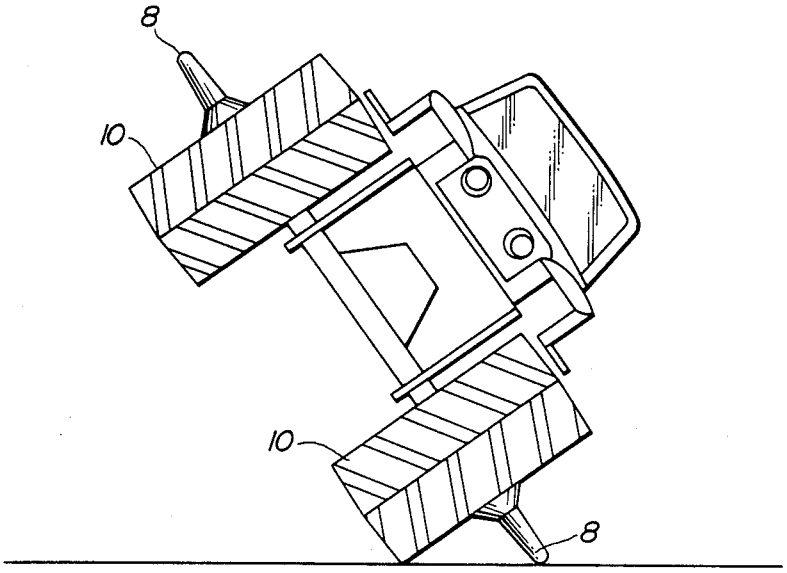
FIG. 2 (PRIOR ART)
FIG. 2 is a end elevation of the second prior art arrangement discussed in the opening paragraphs of the instant disclosure.

FIGS. 3 to 7 show a first embodiment of the present invention. In this arrangement a chassis 100 is provided with front left and right wheels 102 and rear left and right wheels 104. The front wheels 102 are rotatably supported on stub axle members 106 which are pivotally mounted on the front end of the chassis by way of pins 108. The two stub axles 106 are operatively interconnected by a tie rod 110 which extends laterally across the top of the chassis 100 as shown. A steering control servo motor 112 is mounted in the chassis 100 at a location forward of the tie rod 110. The servo motor 112 is connected to the tie rod 110 via a suitable gearing and crank mechanism. The crank mechanism includes a pin (no numeral) which is received between two downwardly extending flanges (no numeral) formed on the lower surface of the tie rod 110.

The servo motor 112 is selectively energizable to rotate in first and second rotational directions and thus permit the tie rod 110 to be selective driven laterally with respect to the vehicle chassis 100 so as to enable the steering of the front wheels 102.

The rear wheels 104 are mounted on an axle 114 which extends across the rear of the vehicle. A reversible drive motor 116 is mounted on the chassis 100 adjacent the axle and operatively connected thereto by a transmission generally denoted by the numeral 118. In this case the transmission 118 takes the form of a two speed arrangement which can be manually switched from one speed to the other by manipulating a projection or button (not shown) which extends from an aperture formed in the lower surface of the chassis 100.

A central wheel 120 is rotatably mounted on the end of a support frame 122. In this embodiment the central wheel 120 is formed with a flat horizontal surface and chamfers at the side corners. The front and rear wheels are hollow to provide pseudo suspension characteristics and are similarly formed to have flat horizontal surfaces bounded by chamfered edges.

Figure 3:
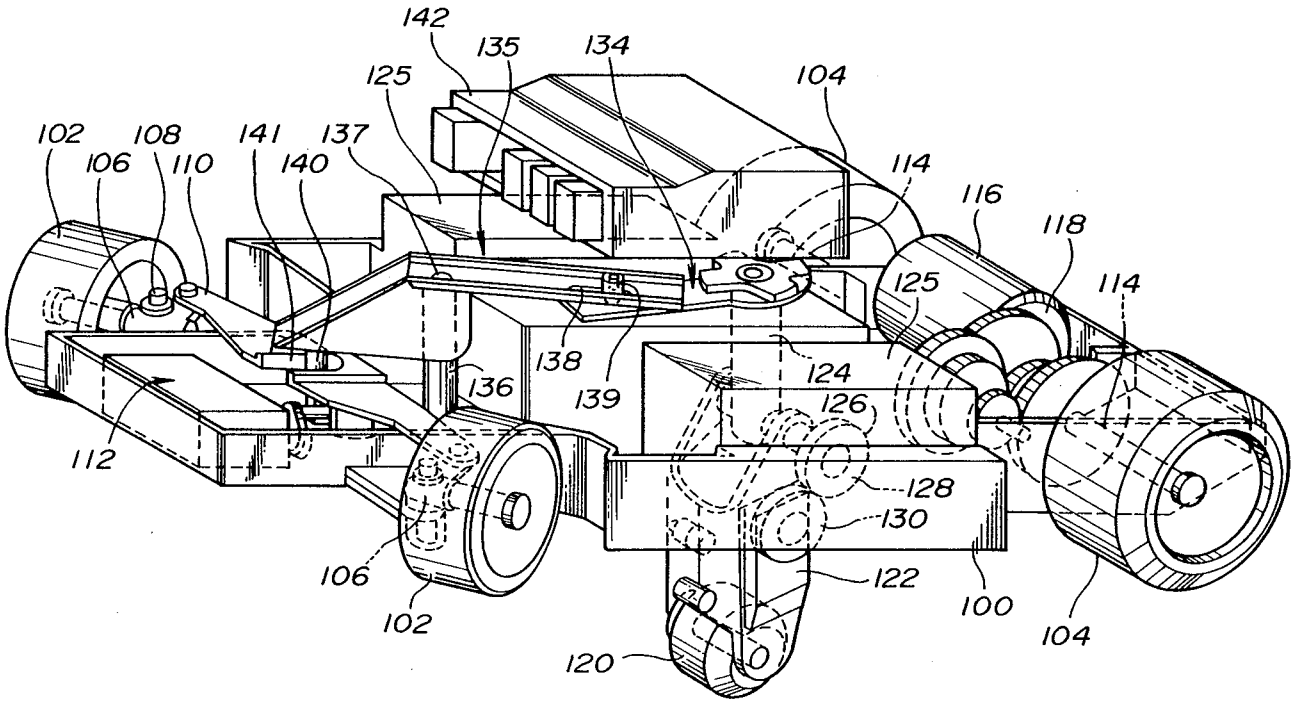
FIG. 3 is a perspective view of a first embodiment of the present invention.
Figure 4:
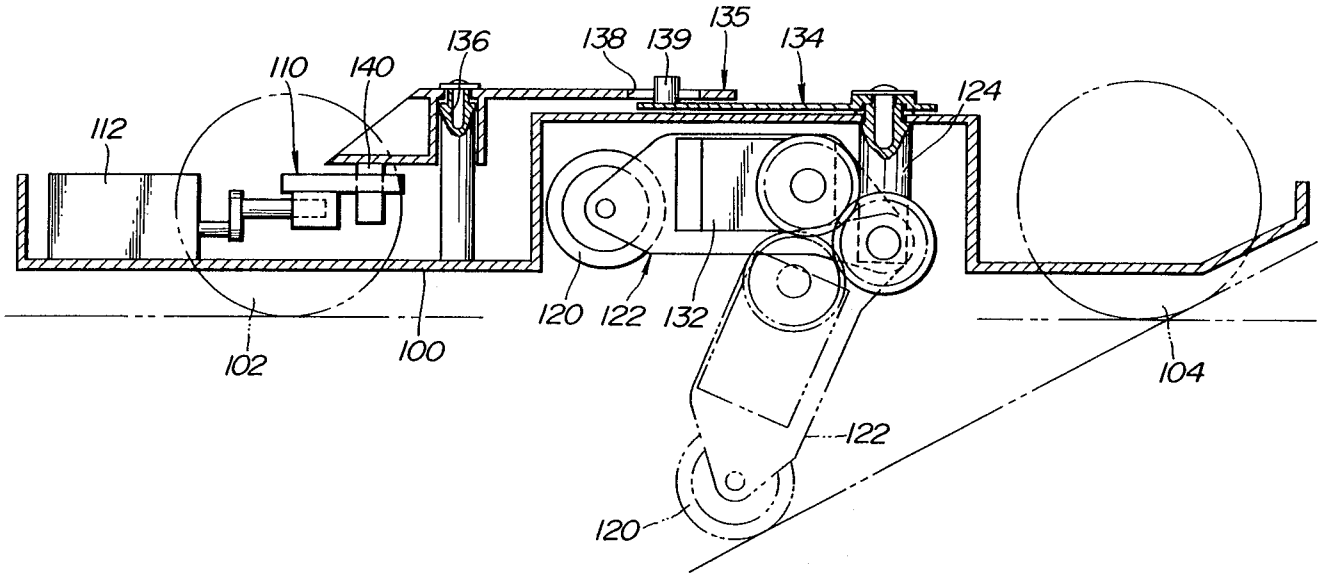
FIG. 4 is a side sectional elevation showing the characteristic arrangement of the first embodiment in operative and inoperative positions.
Figure 5:
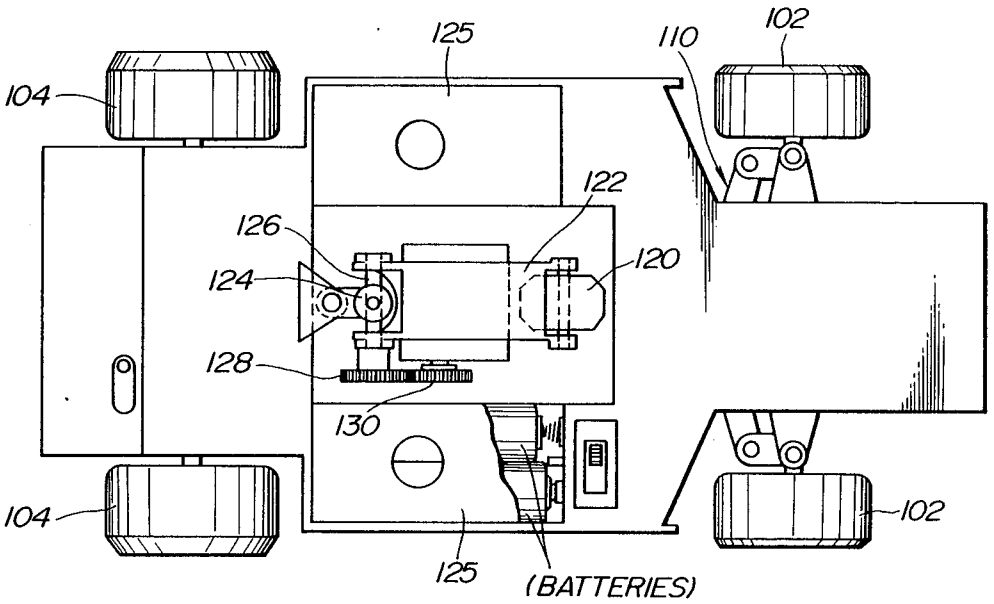
FIG. 5 is a underside plan view of the first embodiment showing the disposition of the "central" wheel and associated support frame structure in a recess formed in the central section of the vehicle chassis.
Figure 6:
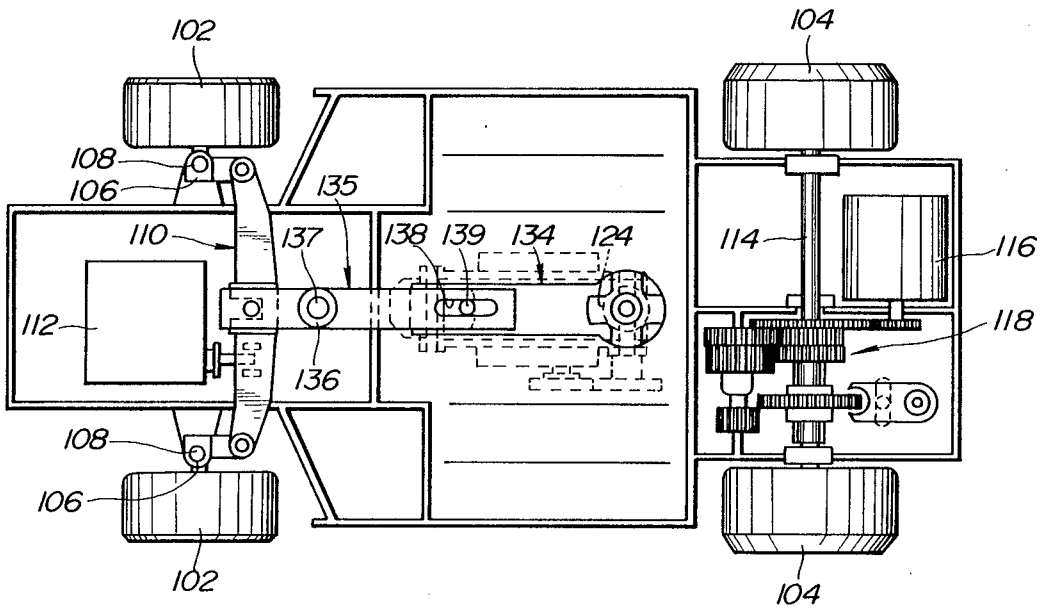
FIG. 6 is a top plan view of the first embodiment showing the operative interconnection between the forward wheel steering mechanism and the central wheel support frame which enables the central wheel to be steered synchronuously with the front ones.
Figure 7:
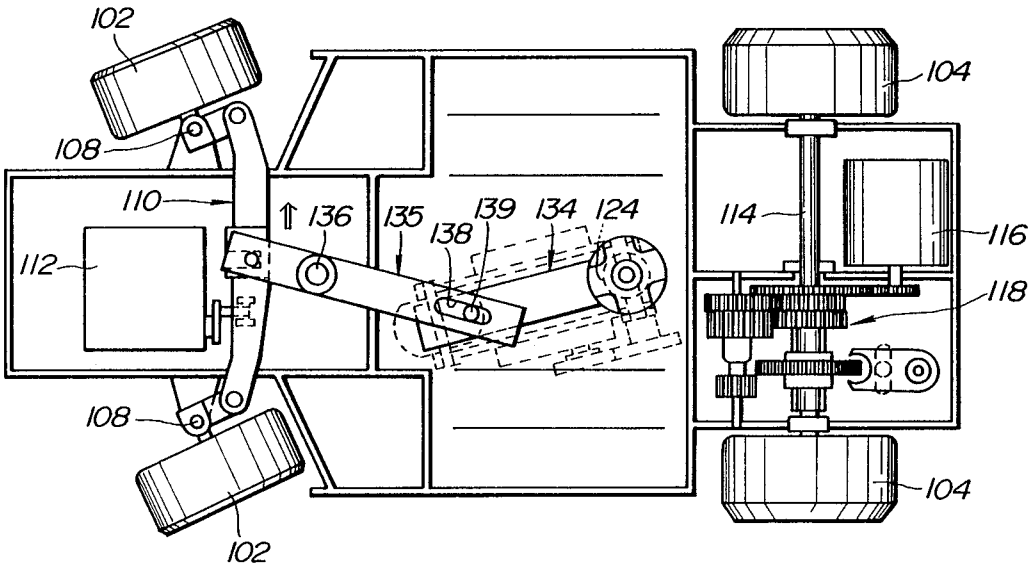
FIG. 7 is a view similar to that shown in FIG. 6 but which shows the forward and central wheels steered in a manner which highlights a feature of the invention which permits the vehicle to be steered under all modes of operation.

A vertical steering pin 124 is rotatably disposed through a suitable bore formed in the chassis 100. As shown in FIGS. 3 and 4 this pin is arranged to project down into a rectangular recess which is defined in the central section of the chassis between two battery boxes 125.

A horizontally extending shaft 126 is disposed through the lower end of the pin. The upper end of the frame 122 is pivotally supported on this shaft 126 as illustrated in FIG. 3. A stationary cog 128 is fixed to one end of the shaft 126 and arranged to mesh with a driven cog 130 rotatably supported on the frame. This driven cog 130 is connected with a servo motor 132 (not shown in this figure) which is disposed in the frame 122 and arranged to be selectively driven in first and second rotational directions depending on whether it is desired to raise or lower the frame with respect to the recess.

The upper end of the steering pin 124 which projects above the upper surface of the chassis 100 is secured to one of two links 134, 135 which interconnect the steering pin 124 with the tie rod 110. The second of the links 135 is pivotally mounted on vertical shaft 136 fixed to or integral with the chassis by way of a screw 137 and formed with an elongate slot 138 which slidably receives a pin 139 provided on the first link 134. The forward end of the second link 135 is formed with a downwardly depending pin or projection 140 which is received in a slot 141 formed in the tie rod.

A receiver unit 142 which picks up control signals emitted by a hand held control unit or the like (not shown), is suitably mounted on top of the chassis 100 and operatively connected with the steering, drive and tilt servos via lead lines and/or other circuitry (not shown).

With the first embodiment when it is desired to change the attitude of the vehicle such as in the case of imitating a wheel stand (wheely), the servo motor 132 of the tilt control mechanism disposed in the frame 122 can be energized to cause the frame 122 to tilt from the position shown in solid line in FIG. 4 toward or to that shown in phantom.

It will be noted that the rear end of the vehicle chassis should be arranged to taper upwardly so as to allow for the changes in vehicle attitude and to avoid abrasion of the same on the surface when the vehicle is running.

With the present invention the connection between the forward wheel steering arrangement and the steering pin 124 to which the upper end of the central wheel support frame is pivotally mounted, induces the central wheel 120 to change direction synchonously and in the same direction as the front wheels 102. Accordingly, when the vehicle is running on the central and rear wheels 120, 104, the vehicle still can be steered in essentially the same manner as if the forward wheels 102 were still running on the ground. Further, if the vehicle has been induced for quick cornering with the central wheel lowered, and has assumed a running on two wheels type attitude, the fact that the one front wheel and the central wheel are steered together make possible stable control of the vehicle while running in this attitude. When the latter mentioned attitude is induced the vehicle runs on the chamfered or tapered edges of the tires. This tends to stabilize the running and facilitate reliable remote control.

Figure 8:
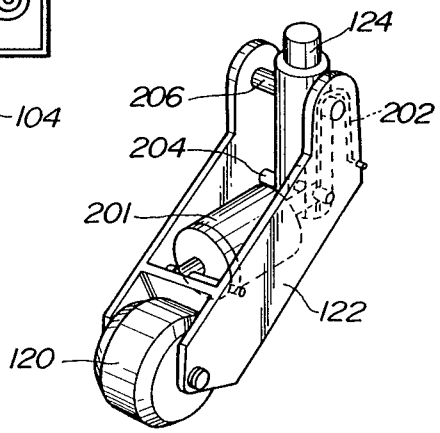
FIG. 8 shows a second embodiment of the present invention wherein the central wheel support frame supports the motor via which the selective raising and lowering thereof during vehicle operation, is accomplished.

FIG. 8 shows a second embodiment of the present invention. In this arrangement the central wheel support frame 122 is provided with a solenoid and return spring arrangement. One end of the solenoid arrangement 201 is pivotally connected to the frame 122 via a pin or similar connection while the other end is pivotally connected to the steering pin 124 via a second transversely extending pin 204. This later mentioned pin 204 however is separate from the frame 122 which is pivotally connected to the steering pin by a slightly larger and more robust pin 206. The return spring 202 takes the form of a torsion spring having one leg anchored to the frame 122, the center portion wound over the pin 206 on which the frame 122 is pivotally connected to the steering pin 124 and a second leg which engages the second transverse pin 204. With this arrangement when the solenoid 201 is energized it elongates and drives the frame to extend downwardly from the chassis 100 to assume the illustrated configuration. When the solenoid 201 is de-energized the return spring 202 induces the frame to swing back up into the rectangular shaped recess defined in the lower face of the chassis 100.

Figure 9:
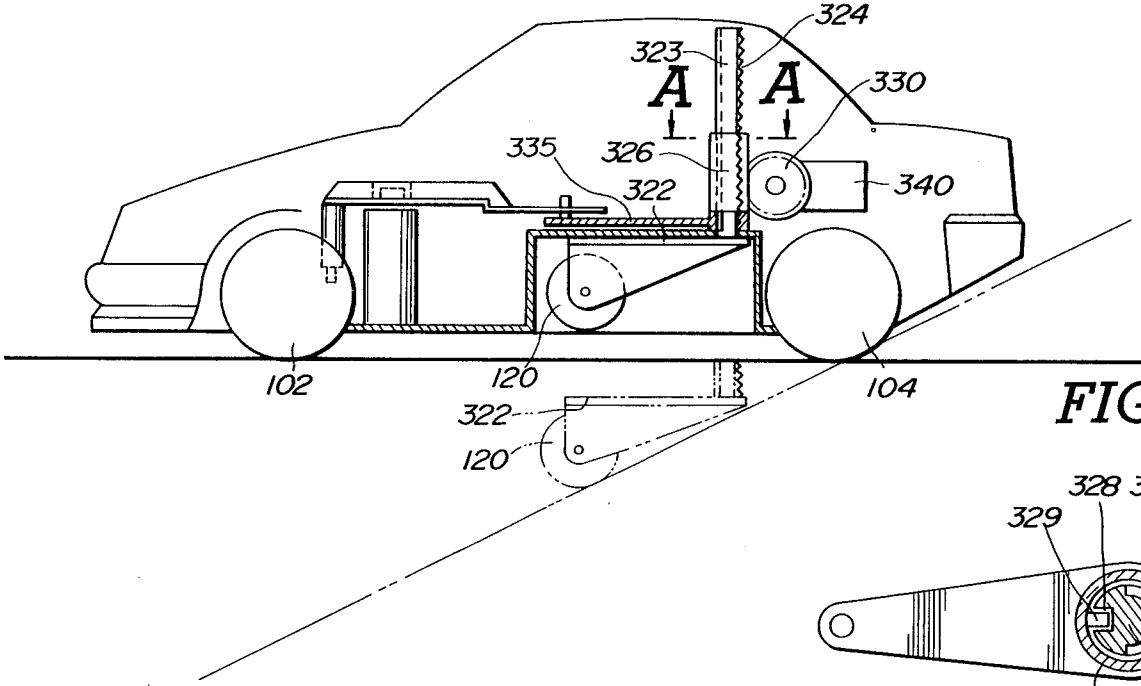
FIG. 9 shows a third embodiment of the present invention which features a central wheel arrangement wherein the frame is arranged to be reciprocatively movable in the vertical direction.
Figure 10:
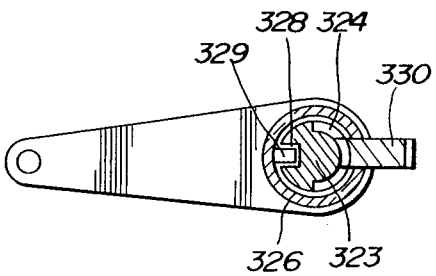
FIG. 10 is a sectional view taken along section section line A—A of of FIG. 9 and which shows details of the mechanism involved with moving the central wheel support frame reciprocatively up and down with respect to the vehicle chassis.

FIGS. 9 and 10 show a third embodiment of the present invention. As shown in FIG. 9, this embodiment moves the frame 322 on which the central wheel 120 is mounted in a reciprocal manner as different from the pivotal movement induced in the first and second embodiments. The frame 322 in this embodiment is provided with a vertically extending shaft 323 which is provided with a rack of gear teeth 324 along one side edge thereof. As shown, the rack teeth are formed to extend approximately half-way round the perimeter of the shaft 323. This shaft 323 is disposed through an opening formed in the chassis and a tubular sleeve 236 which is fixed to or formed integrally with the chassis 100.

The shaft 323 is formed with a guide slot 328 along an edge opposite that on which the gear teeth of the rack are formed. The first link 335 of the arrangement which interconnects the tie rod 110 associated with the front wheels with the frame 322 is formed with a guide 329. This guide is slidably received in the guide slot 328 in the manner shown in FIG. 10. The sleeve 326 is further formed with a slot through which a drive gear 330 is disposed in a manner to operatively engage with the gear teeth formed on the shaft. A motor 340 is supported on the chassis 100 by a bracket arrangement (not shown) and arranged to drive the drive gear 330 in first and second rotational directions depending on whether it is desired to move the frame up or down. As the rack teeth are formed to extend half-way round the shaft 323, a predetermined amount of relative rotation of the shaft 323 with respect to the gear 320 is permitted.

Figure 11:
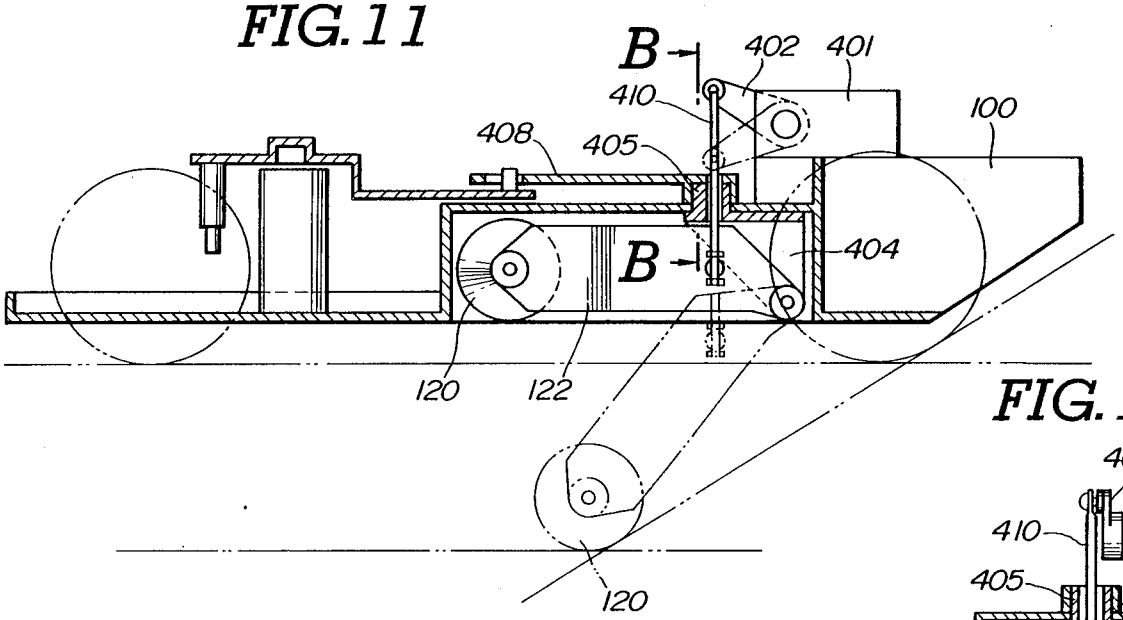
FIG. 11 is a side sectional elevation which shows a fourth embodiment of the present invention wherein the pivoting action of the central wheel support frame is induced by the a crank and push rod-like arrangement which is motivated by a motor disposed on top of the chassis.
Figure 12:
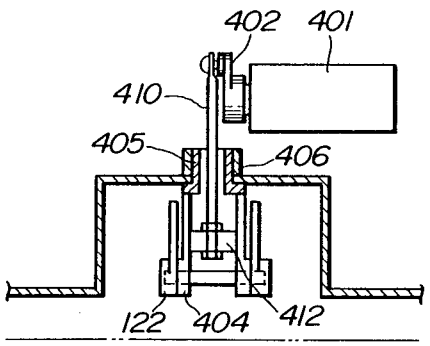
FIG. 12 is a front elevation taken along section line B—B of FIG. 11 and which shows the operative connection between the frame and the motor which motivates the same.

FIGS. 11 and 12 show a fourth embodiment of the present invention. In this embodiment the central wheel support frame 122 is pivoted toward the rear of the vehicle as shown and a crank and con rod—like arrangement connected thereto. In this embodiment the servo motor 401 which motivates the crank arm 402 is mounted on the upper surface of the chassis 100 and arranged to drive the crank arm 402 from the position shown in solid line to that shown in phantom. This movement causes the frame 122 to lower from its stored or inoperative position to its operative one shown in phantom. In order to permit the frame to be steered, the steering pin of the first and second embodiments is replaced with a rotatable bracket 404. This bracket 404 is disposed in the rectangular shaped recess defined in the lower surface of the chassis and provided with a circular boss 405 which projects up through an opening formed in the chassis. The boss 405 is connected to a circular flange 406 formed on the first link 408 of the steering arrangement. The boss 405 includes a through hole through which the the con rod 410 is arranged to pass. The lower end of the con rod 410 is rotatably connected to a pin 412 which extends laterally through the frame (see FIG. 12) and is arranged to intersect with the axis about which the frame 122 is steerable.

Figure 13:
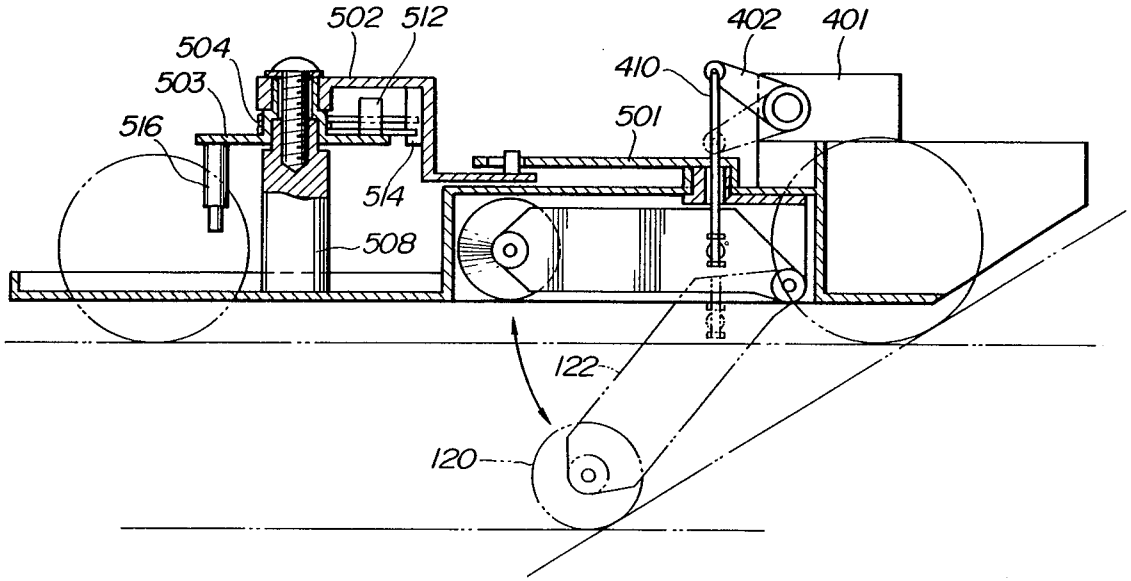
FIG. 13 is a side sectional elevation which shows a fifth embodiment of the present invention which is essentially similar to that shown in FIG. 12 but which features a slightly different steering linkage.
Figure 14:
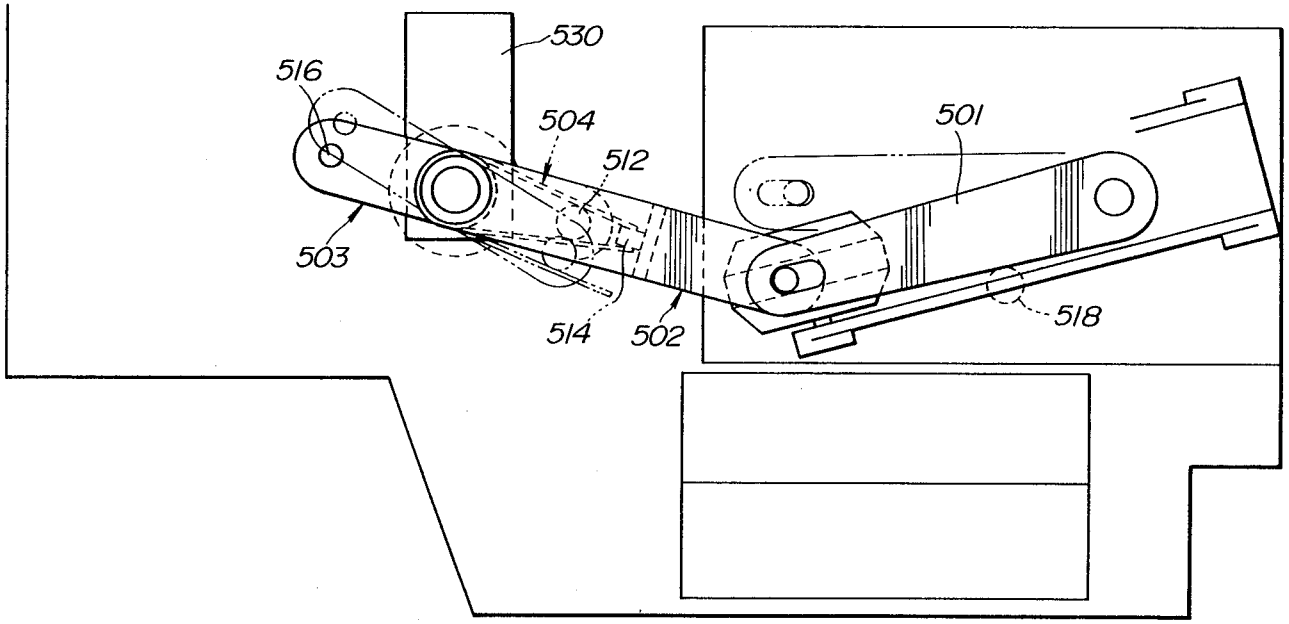
FIG. 14 is a plan view showing the operation of a linkage which interconnects the frame and the steering system of the vehicle.

FIGS. 13 and 14 show a fifth embodiment of the present invention. This embodiment is essentially similar to the fourth one and differs in that the linkage arrangement which interconnects the the tie rod of the steering and the rotatable bracket is modified in a manner to include three links 501, 502 and 503 and a torsion spring 504 which operatively connects the second and third links 502, 503. In this arrangement the second link 502 is pivotally mounted on the small diameter section of a stepped boss formed on the third link 503. The stepped boss is in turn rotatably mounted on a vertically extending boss or bracket 508.

The torsion spring 504 is disposed about large diameter section of the stepped boss and arranged to that the legs thereof stradle a post 512 formed on the upper surface of the third link 503. The legs of the spring 504 are selectively engageable with a rib 514 formed on the lower surface of the second link 502. The third link 503 has a depending post-like member 516 which is engageable in the recess formed in the tie rod (not shown). As shown in FIG. 14 when the steering servo moves the tie rod, the third link 503 is rotated about the bracket 508 and the post 512 engages a leg of the torsion spring 504 and induces a tension in the same. This tension is transmitted to the rib 514 by the other leg of the spring 504 inducing the second link 502 to follow the third link 503 with a slight delay and induce a smooth steering of the central wheel support frame 122.

In this embodiment stoppers 518 are provided on the chassis 100 in a manner to limit the amount of movement of the first link 501. This arrangement permits the central wheel 120 to be steered slightly ahead of the front wheels 102. This enables the vehicle to be selectively induced to "run of two wheels" by steering the central wheel in the retracted position and then lowering the same. Using this technique "running on two wheels" is induced rather than a wheel stand.

As shown in FIG. 14 a possible variant of this embodiment is to arrange the steering servo 530 to be connected directly to the third link 503 and thus use this member to drive the tie rod in a manner which steers the front wheels.

Figure 15:
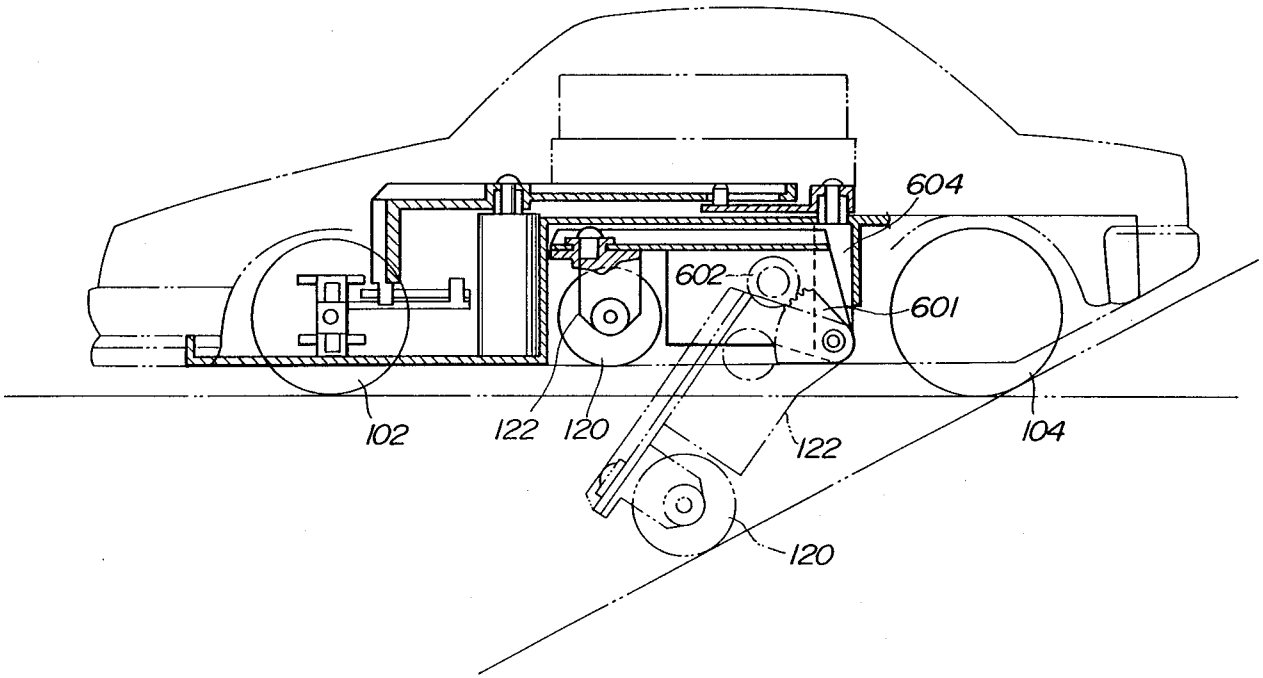
FIG. 15 is a side sectional elevation showing a sixth embodiment of the present invention.

FIG. 15 shows a sixth embodiment of the present invention. In this embodiment the servo motor is disposed to one side of the rectangular recess and the frame 122 on which the central wheel 120 is mounted formed with a sector gear 601. This sector gear 601 is arranged to mesh with a gear 602 driven by the servo motor: Selective operation of the servo motor induces the required movement of the frame 122 in the vertical direction. In this embodiment the frame 122 is pivotally mounted on a rotatable bracket 604 in a manner similar to that used in the fifth embodiment.

Figure 16:
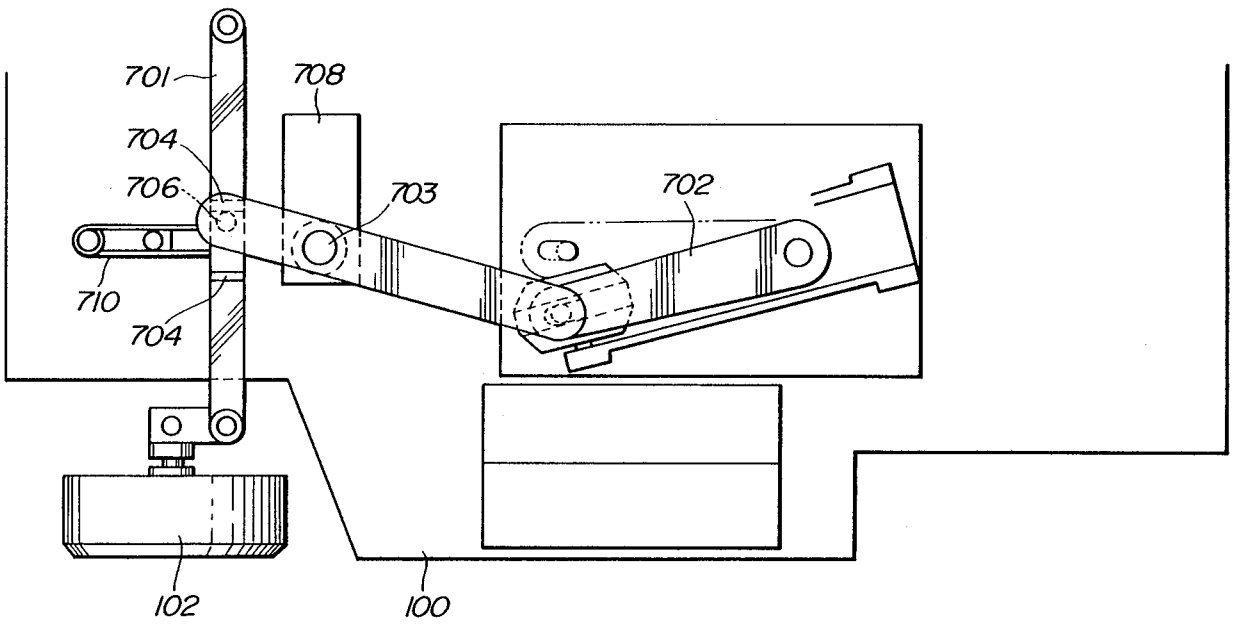
FIG. 16 is a plan view of a steering linkage which is used in a seventh embodiment of the invention.

FIG. 16 shows a seventh embodiment of the present invention. This embodiment is applied to a vehicle arrangement of the nature shown in FIGS. 11 and 12 and is characterized by steering linkage arrangement features the provision of lost motion connection which interconnects the tie rod 701 and the second of two links 702, 702. In this arrangement the tie rod 701 is formed with two ribs 704 on the upper surface thereof. A pin 706 which depends from the second link 703 is engageable with the ribs 704 after having moved through a given angle. In this embodiment the steering servo 708 is arranged behind the level of the tie rod 701 and is drivingly connected with the second link. A torsion spring 710 is operatively interconnected between the chassis 100 and the tie rod 701 and functions to return the tie rod 701 to a central or neutral position. Similar to the previous embodiment, this construction permits the selective induction of "two wheel running" or a wheel stand.

FIGS. 17 to 21 show an eighth embodiment of the present invention. In this embodiment the central wheel support frame 122 is hinged at the forward end of the vehicle and arranged to trail rearwardly. The frame 122 is hinged via radially extending pins 801 to the lower end of a steering pin 802 disposed vertically through the chassis. The upper end of the steering pin 802 is connected to a link 804 of a steering arrangement. The forward end of this link 804 is connected to the tie rod 806 while the rear end is connected pin and slot arrangement 808, 810 to a short link 812. In this arrangement the short link 812 is connected to a steering servo 814 which located toward the rear of the vehicle. The short/long link arrangement provides a mechanical advantage for the steering servo 814.

Figure 19:
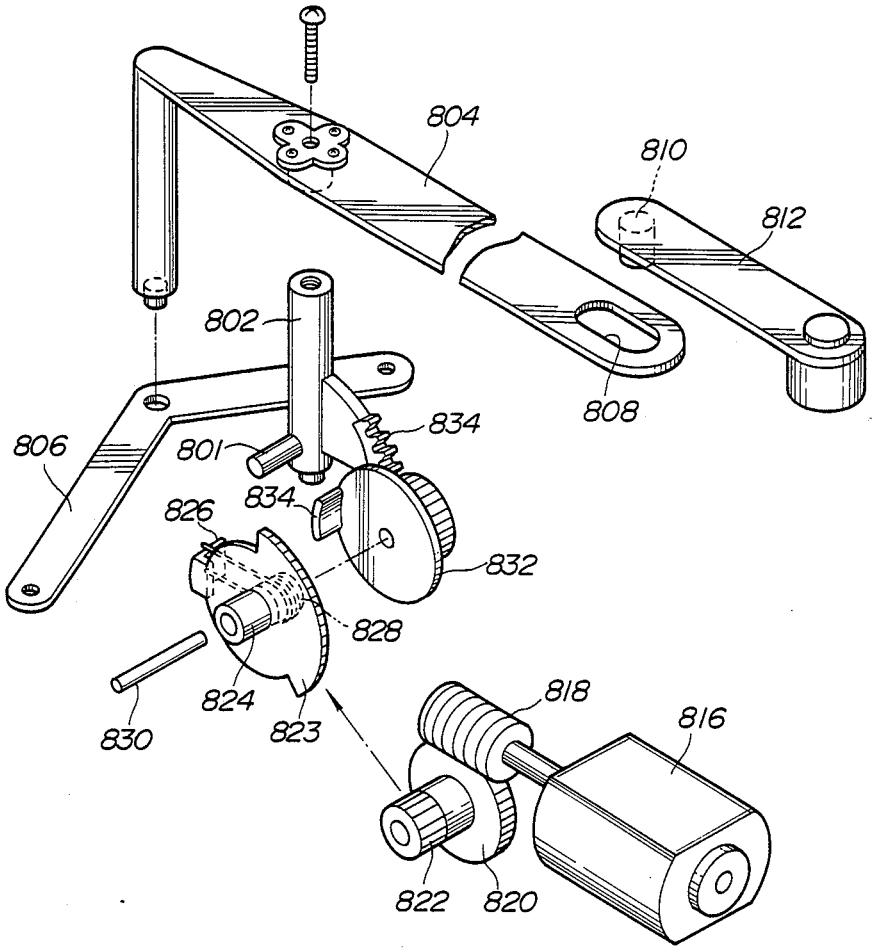
FIG. 19 is an exploded view showing the construction of the steering and central wheel support frame control mechanism of the eighth embodiment.
Figure 20:
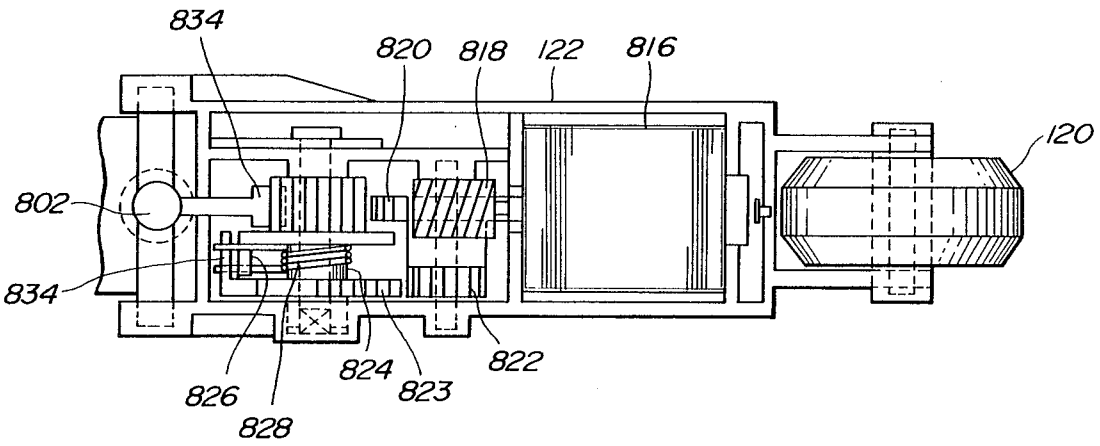
FIG. 20 is a plan view showing the arrangement shown in FIG. 18 assembled in the support frame.

FIG. 19 shows the steering and tilting mechanism is exploded form. As will be appreciated, the tilt servo 816 which is mounted in the frame 122 has a worm gear 818 on its output shaft. This worm meshes 818 with a large diameter gear 820. A small diameter gear 822 which is formed on the same rotatable element as the larger gear 820 is arranged to mesh with a sector gear 823. The sector gear 823 includes a cylindrical shaped boss 824 in which a axial through hole is formed. The sector gear 823 further includes an axial extending flange 826 at the periphery thereof. A torsion spring 828 is mounted on the cylindrical boss 824 and arranged to that the legs thereof extend on either side of the flange 826. A shaft 830 is rotatably disposed through the axial through hole of the sector gear 823 and arranged to further support a gear element 832 which meshes with a rack 834 formed on the steering pin 802. This gear element 832 includes a disc portion which has an axially extending flange 834 formed on the periphery thereof. The two flanges 826, 834 are arranged to overlap each other in a manner as shown in FIG. 20. The legs of the torsion spring 828 are arranged to enclose both of the flanges 826, 834 and thus establish a resilient drive connection between the sector gear 823 and the gear element 832. With this arrangement when the tilt servo 816 is energized the sector gear 828 is rotated in a manner which tends to spread the legs of the torsion spring 828 and induce a tension therein. This tension is transmitted to the gear element 832 in a manner induces rotation of the same in the same direction as the sector gear 823. Depending on the direction in which the tilt servo 816 is being run the frame 122 is induced to pivot smoothly up or down as the situation demands.

Figure 21:
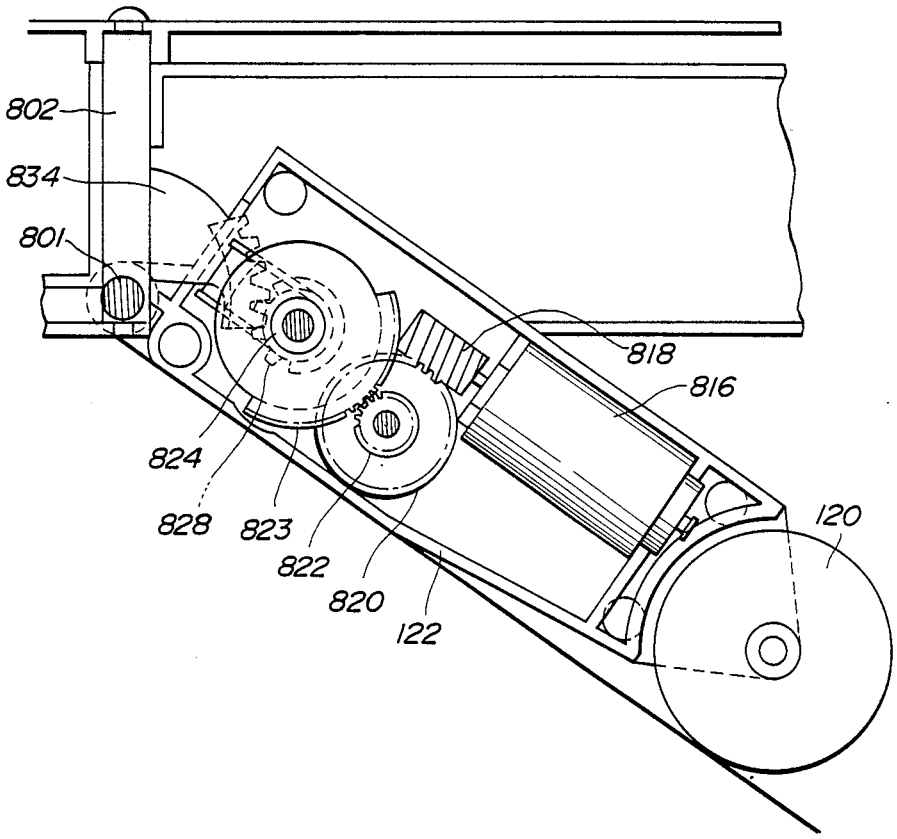
FIG. 21 is a side elevation showing the frame of the eighth embodiment conditioned to induce the vehicle chassis to assume a wheely type attitude.

FIG. 21 shows the torsion spring 828 having returned essentially to a non stressed state.

Figure 22:
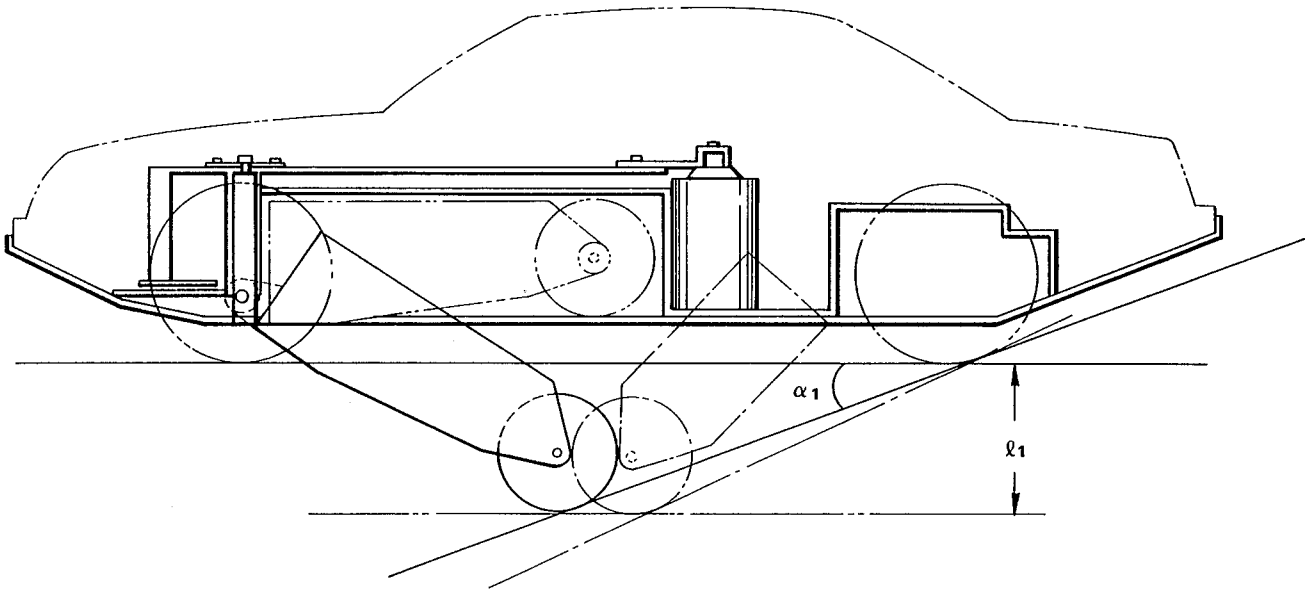
FIG. 22 is a side elevation of a chassis according to the invention showing a body (shown in phantom) and showing two different techniques in which the central wheel support frame arrangement shown in FIG. 21 can be pivotally arranged with the chassis.

FIG. 22 shows the possible variations in mounting arrangement and the inherent advantages and disadvantages of the same.

Figure 23:
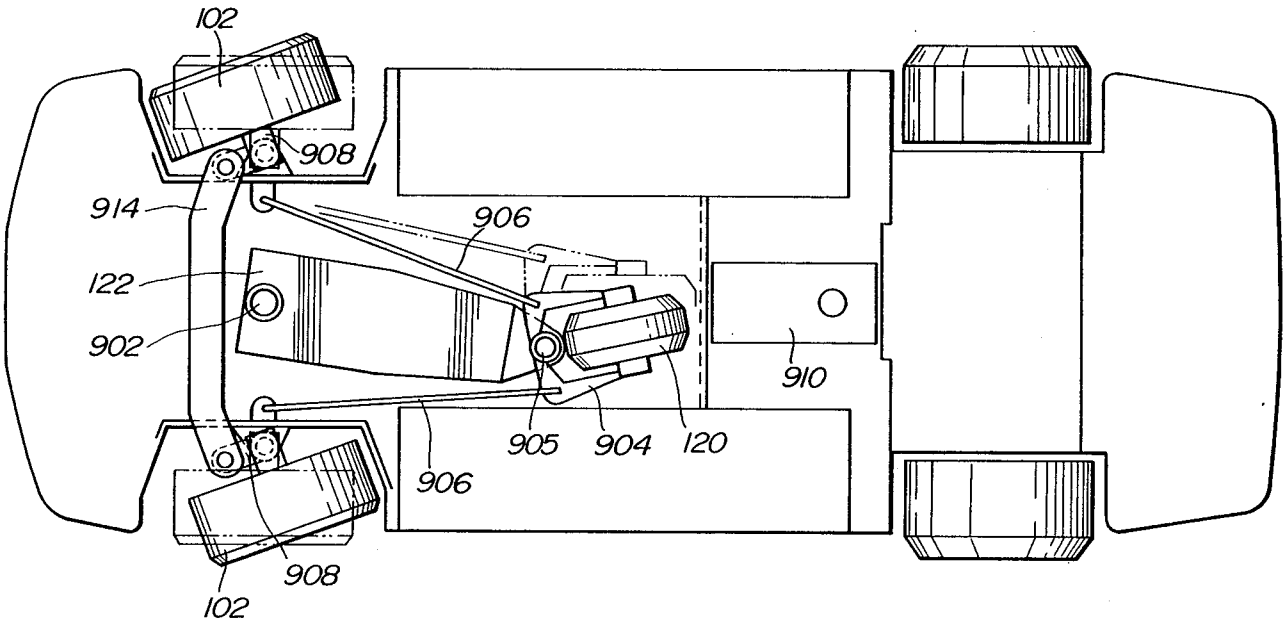
FIG. 23 is an underside plan view showing a ninth embodiment of the present invention wherein the central wheel is steered by a bridle like arrangement comprised of trailing links which lead from pivotally mounted members on which the front wheels are rotatably supported.
Figure 24:
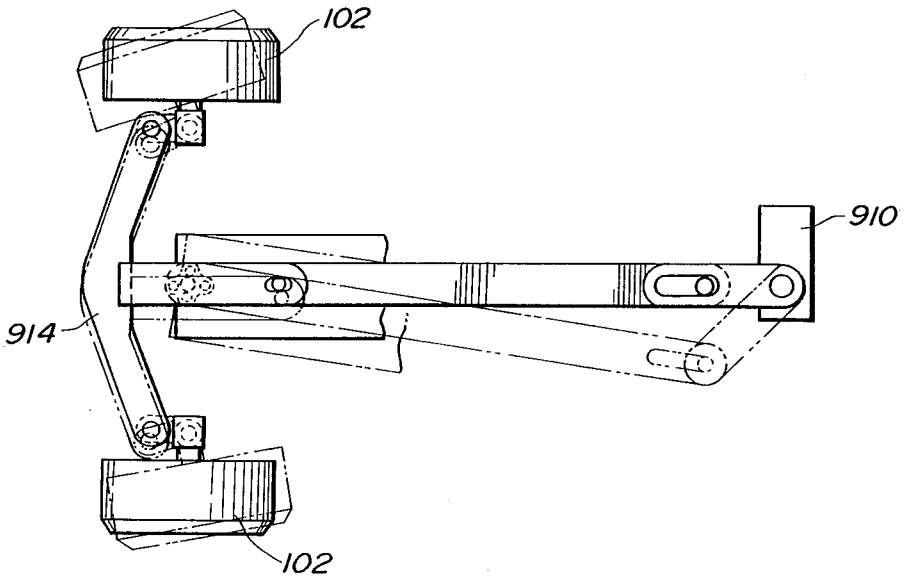
FIG. 24 is a plan view showing the steering linkage used in the ninth embodiment of the present invention.
Figure 25:
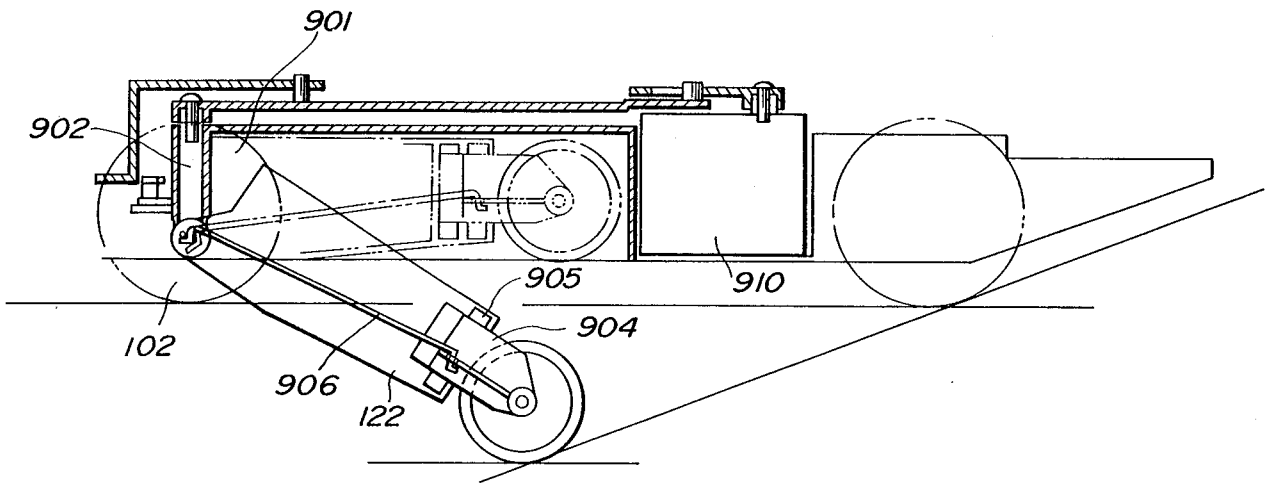
FIG. 25 is a side elevation showing the ninth embodiment with the central wheel support frame conditioned to produce a wheel stand or wheely like attitude.

FIGS. 23 to 25 show a ninth embodiment of the present invention. In this embodiment the frame 122 is pivotally mounted on a rotatable bracket 901 which is connected the lower end of a steering pin 902. The central wheel 120 is supported on a bracket 904 which is pivotally mounted on a pin 905 in a manner as shown in FIG. 25. Trailing arms 906 which resemble a horses bridle interconnect the extended inboard ends of a stub shaft members 908 on which the forward wheels 102 are mounted, with the corners of the pivotal bracket 904. With this arrangement when the front wheels 102 are steered a corresponding steering action is induced in the central wheel 120 as depicted in FIG. 23. As also shown in this figure the steering servo 910 is disposed toward the rear of the vehicle and connected with the steering pin and the tie rod 914 with the linkage arrangement shown in FIG. 24. The trailing arms 906 are pivotally connected at there both ends and at there upper ends at points which are fall on the axis about which the frame is arranged to pivot.

Figure 17:
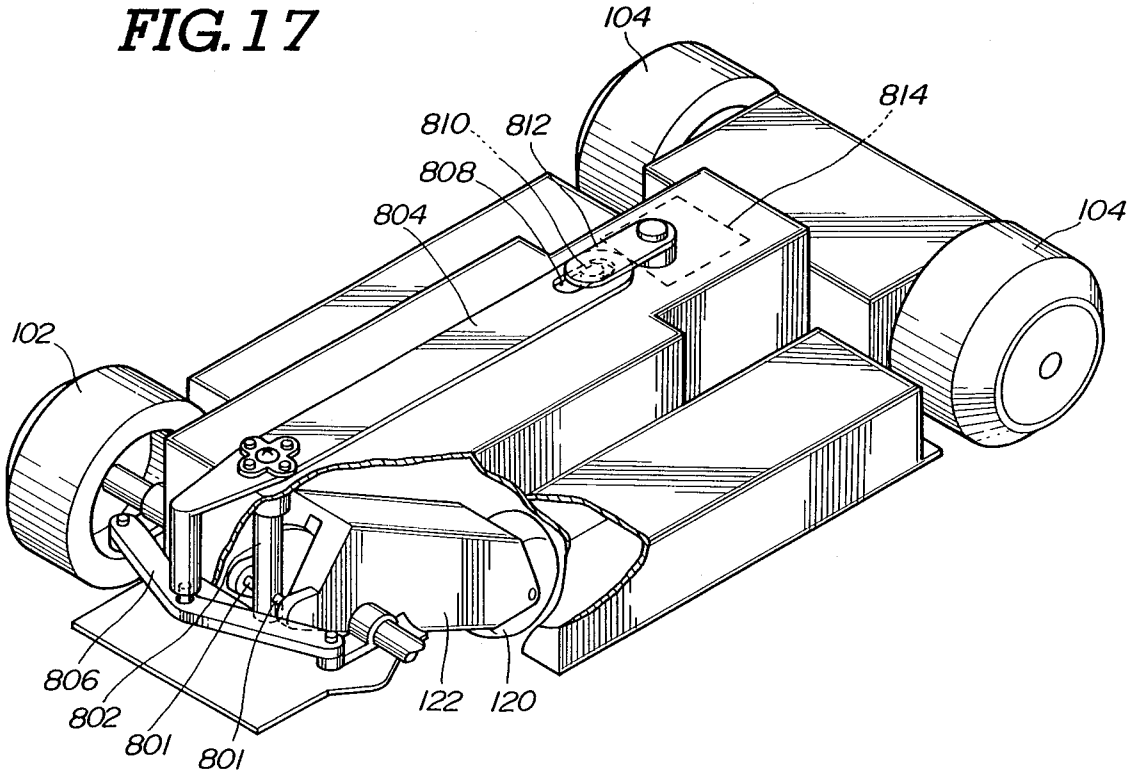
FIG. 17 is a perspective view of a eighth embodiment of the present invention wherein the central wheel support frame is pivotally mounted to the vehicle chassis at a location close to the forward end of the vehicle and arranged to trail rearwardly.
Figure 18:
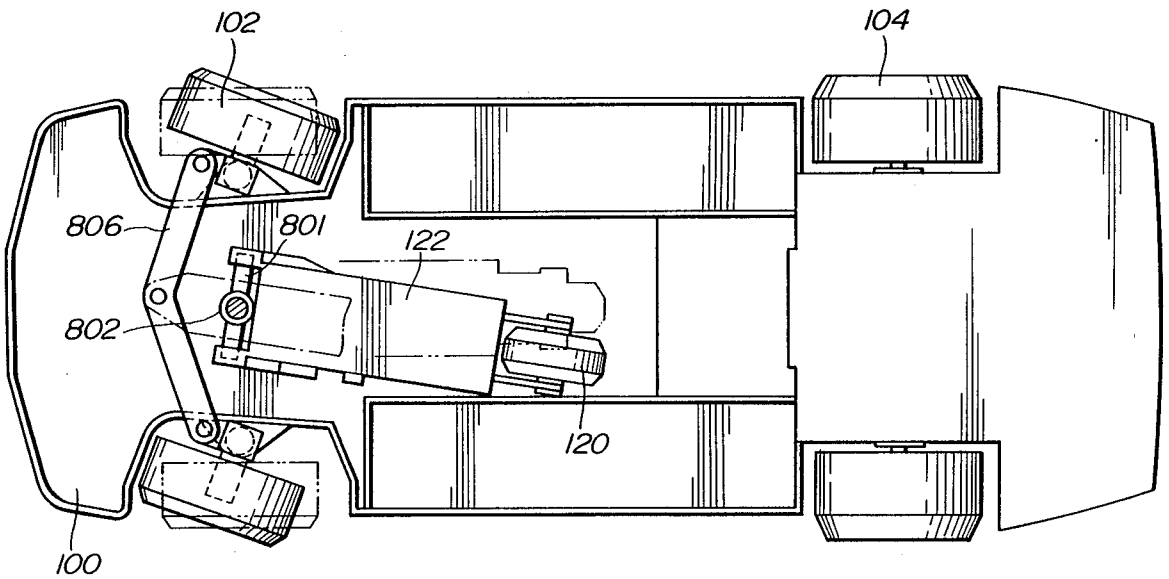
FIG. 18 is an underside plan view of the eighth embodiment showing the wheels of the vehicle conditioned to produce a left hand turn.

The steering arrangement which interconnects the steering servo 910 and the tie rod 914 is essentially similar to that disclosed in connection with the arrangement shown in FIGS. 17 and 19. As such a redundant repetition of the same will be be omitted for brevity.

Figure 26:
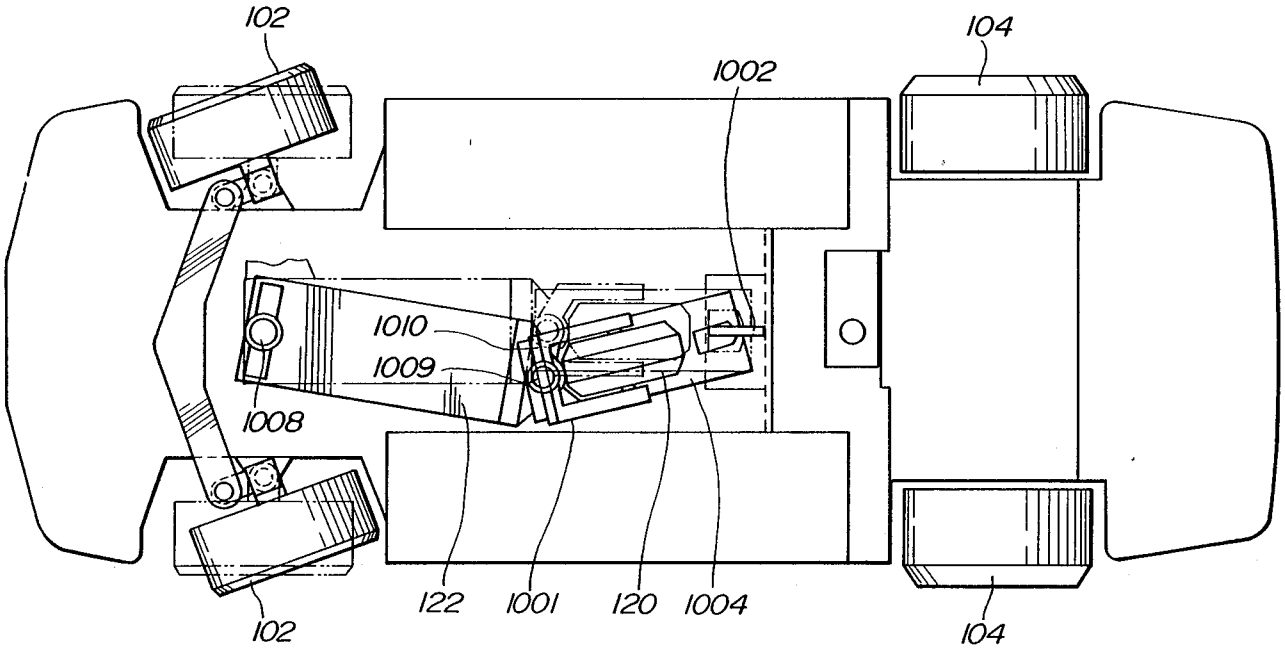
FIG. 26 is an underside plan view of a tenth embodiment of the present invention.
Figure 27:
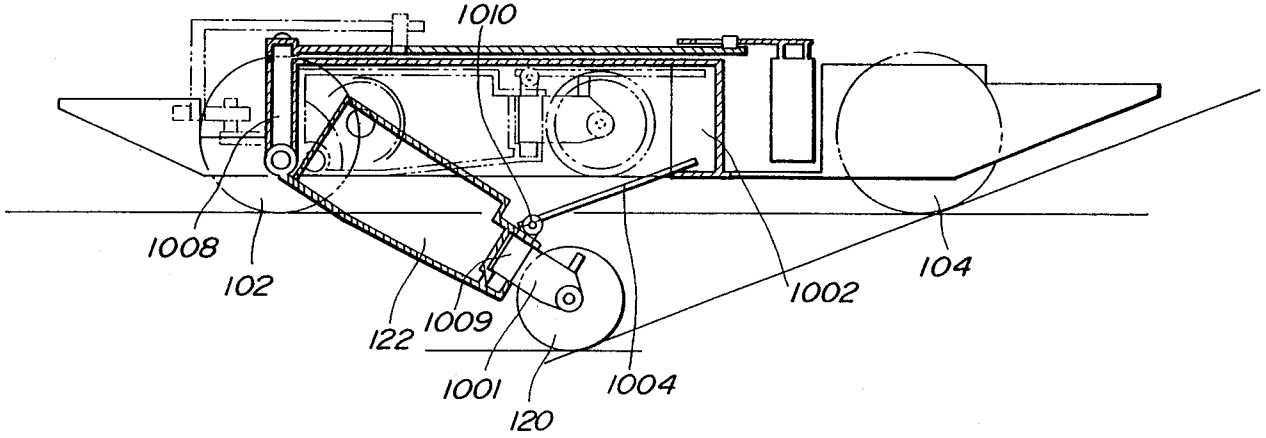
FIG. 27 is a side elevation showing the tenth embodiment producing a wheely like vehicle attitude.

FIGS. 26 and 27 show a tenth embodiment of the present invention. In this embodiment the trailing arms of the previous embodiment eliminated and the pivotal bracket 1001 on which the central wheel 120 is supported is connected to a rib 1002 formed in the center of the rectangular shaped recess defined in the lower face of the chassis by a single arm 1004 which trails rearwardly from the bracket 1001. In this embodiment the trailing arm 1004 is hinged to the top of the pin 1009 about which the bracket 1001 is pivotal by a hinge arrangement 1010. The end of the trailing arm which grip the rib 1002 are arranged to have round nose-like nipper portions which permit rotation and relative sliding motion to occur.

The forward end of the frame 122 is hingely mounted on a rotatably bracket (not shown in FIG. 26) connected to a steering pin 1008. The steering mechanism in this embodiment is essentially the same as that used in the embodiment shown in 17.

Although the above embodiments have been disclosed in connection with a four wheeled remote controlled vehicle, it is to be understood that the invention is not limited to the same and can be applied to non-remote controlled vehicles wherein a memory (mechanical or electronic) is provided onboard, with two wheeled vehicles (i.e. motor cycles) tanks, toy air craft having three or more wheels, etc. It is also within the scope of the present invention to provide two or more auxiliary wheels on the structure which can be lowered beneath the vehicle and arrange the same so that the vehicle can be lifted completely off the ground (Viz. simulate jumping, flying, etc.)

What is claimed is:

1. An action toy vehicle comprising:
a vehicular chassis;
a plurality of road wheels rotatably suspended from said vehicular chassis;
an auxiliary wheel;
a structure for supporting an auxiliary wheel, said structure being so constructed and arranged so as to be selectively shifting said auxiliary wheel between a first position in which said plurality of road wheels are in contact with a road surface and a second position in which said auxiliary road wheel is lowered for lifting a portion of the vehicular chassis for releasing at least one road wheel from a road surface;
means for selectively providing a control signal; and
means for selectively activating said structure in response to said control signal for shifting said auxiliary wheel from said first position to said second position while said vehicle is in motion on the road surface.

2. A vehicle as claimed in claim 1 wherein said plurality of road wheels have chamfered sections on the outboard edges thereof and said auxiliary wheel is formed with chamfered section on both edges thereof.

3. A vehicle as claimed in claim 1 wherein said plurality of road wheels comprises at least one driven wheel and at least one steerable wheel.

4. A vehicle as claimed in claim 3 further comprising a steering mechanism interconnecting said structure and said at least one steerable wheel, said steering mechanism being so constructed and arranged as to steer said at least one steerable wheel and the auxiliary wheel in essentially the same direction.

5. A vehicle as claimed in claim 4 wherein steering mechanism includes a servo motor which can be selectively operated by remote control.

6. A vehicle as claimed in claim 4 wherein said structure includes a frame pivotally mounted on the lower end of a rotatable pin, said pin being operatively connected with said steering mechanism.

7. A vehicle as claimed in claim 4 wherein said structure includes a frame pivotally mounted on a rotatable bracket, said rotatable bracket being operatively connected with said steering mechanism.

8. A vehicle as claimed in claim 6 wherein said structure includes a member on which said frame is pivotally mounted and an auxiliary wheel control servo motor, said auxiliary wheel control servo motor being mounted on said frame and operatively connected to the member on which said frame is pivotally mounted by gearing means.

9. A vehicle as claimed in claim 7 wherein said structure includes a member on which said frame is pivotally mounted and an auxiliary wheel control servo motor, said auxiliary wheel control servo motor being mounted on said frame and operatively connected to the member on which said frame is pivotally mounted by gearing means.

10. A vehicle as claimed in claim 6 wherein said structure includes an auxiliary wheel control servo motor, said auxiliary wheel control servo motor being mounted on said chassis and operatively connected to said frame by connection means.

11. A vehicle as claimed in claim 7 wherein said structure includes an auxiliary wheel control servo motor said auxiliary wheel control servo motor being mounted on said chassis and operatively connected to said frame by connection means.

12. A vehicle as claimed in claim 1, further comprising an arrangement for steering said auxiliary wheel.

13. A vehicle as claimed in claim 12 wherein said auxiliary wheel steering arrangement includes a selectively operable servo motor.

14. A vehicle as claimed in claim 13 further comprising a road wheel steering means for steering at least one of said plurality of road wheels.

15. A vehicle as claimed in claim 14 wherein said auxiliary wheel steering arrangement and said road wheel steering means are operatively interconnected.

16. A vehicle as claimed in claim 12 wherein said auxiliary wheel steering arrangement includes a wheel support bracket which is pivotally mounted on said structure, said pivotally mounted wheel support bracket being linked to one of said chassis and said road wheel steering means by a trailing arm in a manner which steers the same.

17. An action toy vehicle as set forth in claim 1, wherein said means performs remote control of said structure for activating the latter at an optional timing.

18. An action toy vehicle as set forth in claim 1, wherein said means is further operable for operating said structure for causing shifting of said auxiliary wheel from said second position to said first position at optional timing.

19. An action toy vehicle comprising:
a vehicular chassis;
a plurality of road wheels rotatably suspended from said vehicular chassis;
a steerable auxiliary wheel;
a first structure for supporting said auxiliary wheel, said structure being so constructed and arranged so as to be selectively shifting said auxiliary wheel between a first position in which said plurality of road wheels are in contact with a road surface and a second position in which said auxiliary road wheel is lowered for lifting a portion of the vehicular chassis for releasing at least one road wheel from a road surface;
means for selectively providing a control signal;
means for selectively activating said structure in response to said control signal for shifting said auxiliary wheel from said first position to said second position while said vehicle is in motion on the road surface; and
a second structure operating said auxiliary wheel for steering while said auxiliary wheel is placed in said second position.

20. An action toy vehicle comprising:
a vehicular chassis;
a plurality of road wheels rotatably suspended from said vehicular chassis;
a steerable auxiliary wheel;
a first structure rotatably supporting said auxiliary wheel, said first structure normally holding said auxiliary wheel at a first position in which said auxiliary wheel is placed away from a road surface, being operable to a second position in which said auxiliary wheel is projected for lifting a front end of the vehicle for wheely action, and to a third position in which said auxiliary wheel is projected for lifting desired one lateral side of the vehicular chassis for two wheel drive action; and means for optionally and selectively activating said structure for operating said auxiliary wheel from said first position to one of said second and third positions.

21. An action toy vehicle as set forth in claim 20, wherein said structure normally holds said auxiliary wheel at a lateral center of said vehicular chassis and causes lateral offset when said auxiliary wheel is operated to said third position.

22. An action toy vehicle as set forth in claim 20, wherein said auxiliary wheel placed at said first position and at said second position in neutral position of steering, is oriented around the gravity center in longitudinal and lateral directions.

23. An action toy vehicle as set forth in claim 20, wherein said road wheels includes a steerable wheel associated with a vehicular steering mechanism which is associated with said auxiliary wheel for causing steering action for the latter when said auxiliary wheel is operated to said second and third position.

24. An action toy vehicle as set forth in claim 23, which further comprises a mechanical means for coupling said steering mechanism to said auxiliary wheel.

25. An action toy vehicle as set forth in claim 23, which further comprises an electrical means for electrically coupling said steering mechanism to said auxiliary wheel.

26. An action toy vehicle as set forth in claim 21, wherein said auxiliary wheel laterally offsets toward the inside of the vehicular chassis close to curve center.

27. An action toy vehicle as set forth in claim 21, wherein said auxiliary wheel laterally offsets toward the outside of the vehicular chassis remote from curve center.

28. An action toy vehicle comprising:

a vehicular chassis;

a plurality of road wheels rotatably suspended from said vehicular chassis;

a steerable auxiliary wheel;

a first structure for supporting said auxiliary wheel, said structure being so constructed and arranged so as to be selectively shifting said auxiliary wheel between a first position in which said plurality of road wheels are in contact with a road surface and a second position in which said auxiliary road wheel is lowered for lifting a portion of the vehicular chassis for releasing at least one road wheel from a road surface;

a second structure for operating said auxiliary wheel for steering while said auxiliary wheel is placed in said second position;

means for selectively providing a control signal; and means for selectively activating said first and second structure in response to said control signal for shifting said auxiliary wheel from said first position to said second position while said vehicle is in motion on the road surface and causing steering action in said auxiliary wheel for selectively performing desired wheely action and lifting of one side of said vehicle.

* * * * *